United States Patent [19]

MacNitt, Jr.

[11] 3,986,803

[45] Oct. 19, 1976

[54] COVER POSITIONING DEVICE FOR CONTAINER IN A COMPACTING PRESS

[75] Inventor: Donald G. MacNitt, Jr., North Palm Beach, Fla.

[73] Assignee: United Technologies Corporation, Hartford, Conn.

[22] Filed: Dec. 4, 1975

[21] Appl. No.: 637,623

[52] U.S. Cl. ..... 425/78; 425/258; 425/123; 425/126 R; 425/128

[51] Int. Cl.[2] ..... B30B 11/02

[58] Field of Search ..... 425/78, 407, DIG. 35, 425/412, 126, 128

[56] References Cited

UNITED STATES PATENTS

| | | | |
|---|---|---|---|
| 3,189,942 | 6/1965 | Rapprich et al. | 425/78 |
| 3,307,221 | 3/1967 | Bolner | 425/DIG. 35 |
| 3,521,326 | 7/1970 | Rice et al. | 425/78 |
| 3,555,597 | 1/1971 | Meadows | 425/78 |
| 3,577,842 | 5/1971 | Nakai et al. | 425/78 X |
| 3,832,107 | 8/1974 | Cox et al. | 425/78 |

*Primary Examiner*—J. Howard Flint, Jr.
*Attorney, Agent, or Firm*—Charles A. Warren

[57] ABSTRACT

In a compacting press, the container in which the material is compacted is sealed by a cover which is positioned in the open end of the filled container before the container is removed from the press. The cover positioning device is movable into and out of operative position to permit operation of the press and the apparatus is remotely controlled externally of the vacuum chamber in which the press is located.

8 Claims, 4 Drawing Figures

COVER POSITIONING DEVICE FOR CONTAINER IN A COMPACTING PRESS

SUMMARY OF THE INVENTION

The principal feature of the invention is a cover positioning apparatus that has mechanism for holding a cover and is movable into and out of operative position over the container to position the cover on the container and to be retracted so that the ram of the press may function. This cover carrier is mounted for movement with a vertically movable support in order that the cover carrier will not interfere with the upward movement of the support which carries the container and ram heater into operative position to permit removal of the filled container. Water cooled shielding is provided to protect the actuating devices because of the high temperature within the press enclosure.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

The press shown in this application is a part of a particulate matter compacting apparatus described in the copending application of Jerry A. King et al., Ser. No. 637,624, filed Dec. 4, 1975, and having the same assignee as the present application. Parts of the press structure are described in greater detail in that application. The present invention is directed to the apparatus by which the cover is placed on the container and the related structure necessary to accomplish this.

Figure 1:
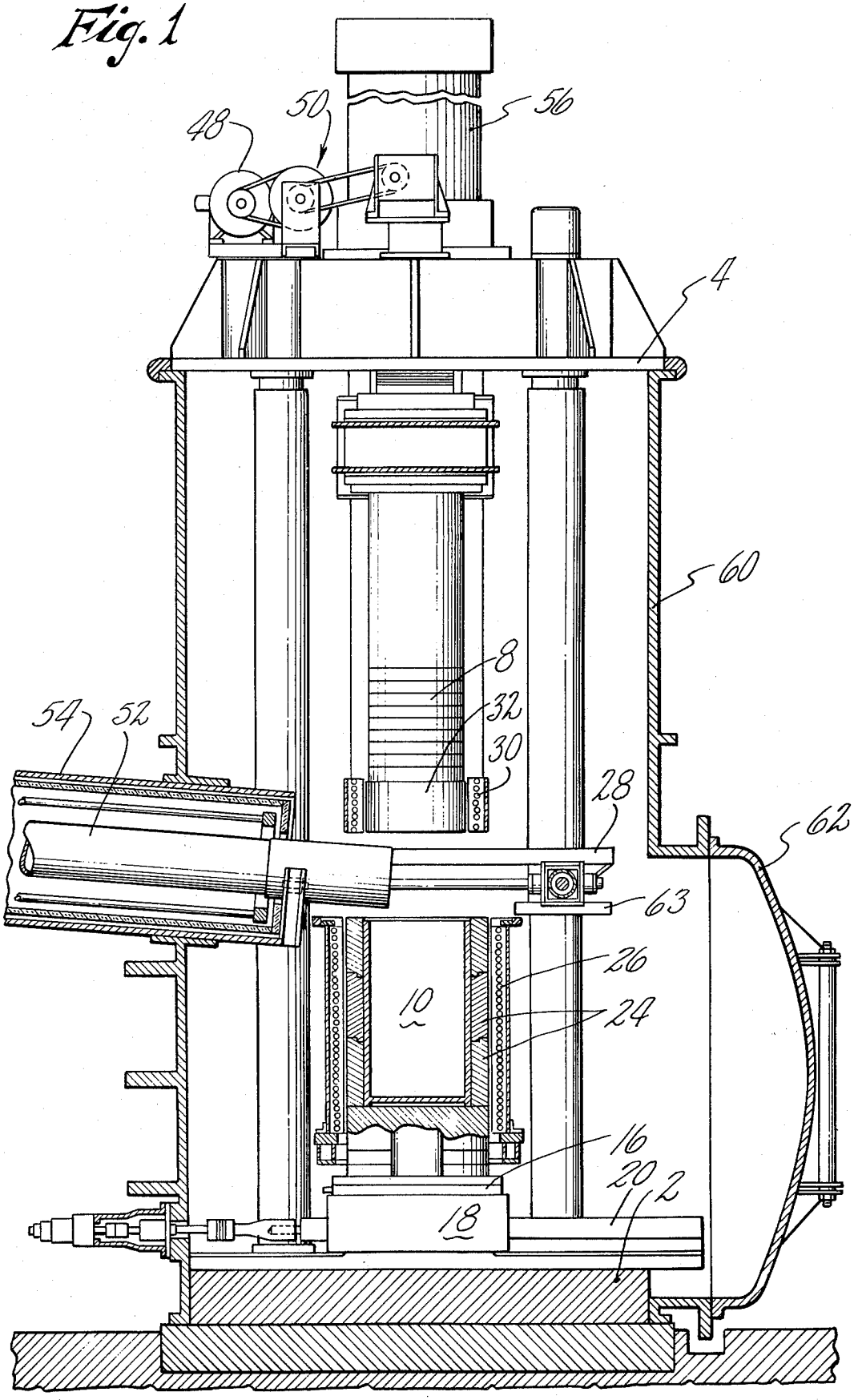
FIG. 1 is a vertical sectional view through the press.

Referring first to FIG. 1, the press has a base plate 2 and a head plate 4 held together by a plurality of tie bolts 6, FIG. 3, that extend between the two plates and carry the load of the ram 8 when the latter is moved downwardly to compress particulate matter in the container 10 positioned below the ram. The tie bolts 6 are surrounded by columns 12 extending between the base and head plates, and the columns are enclosed in water jackets 14. The bolts are secured in the base plate and nuts, not shown, hold the head plate in position on the bolts.

The container 10 is positioned on a water cooled plate 16 on a slide 18 supported on horizontal guides 20. This slide is moved laterally through a feed screw 22 to move the container to an accessible position offset from the ram 8. The container 10 is surrounded by stacked rings 24 forming a susceptor and an induction heating coil 26 surrounds the rings 24.

Figure 2:
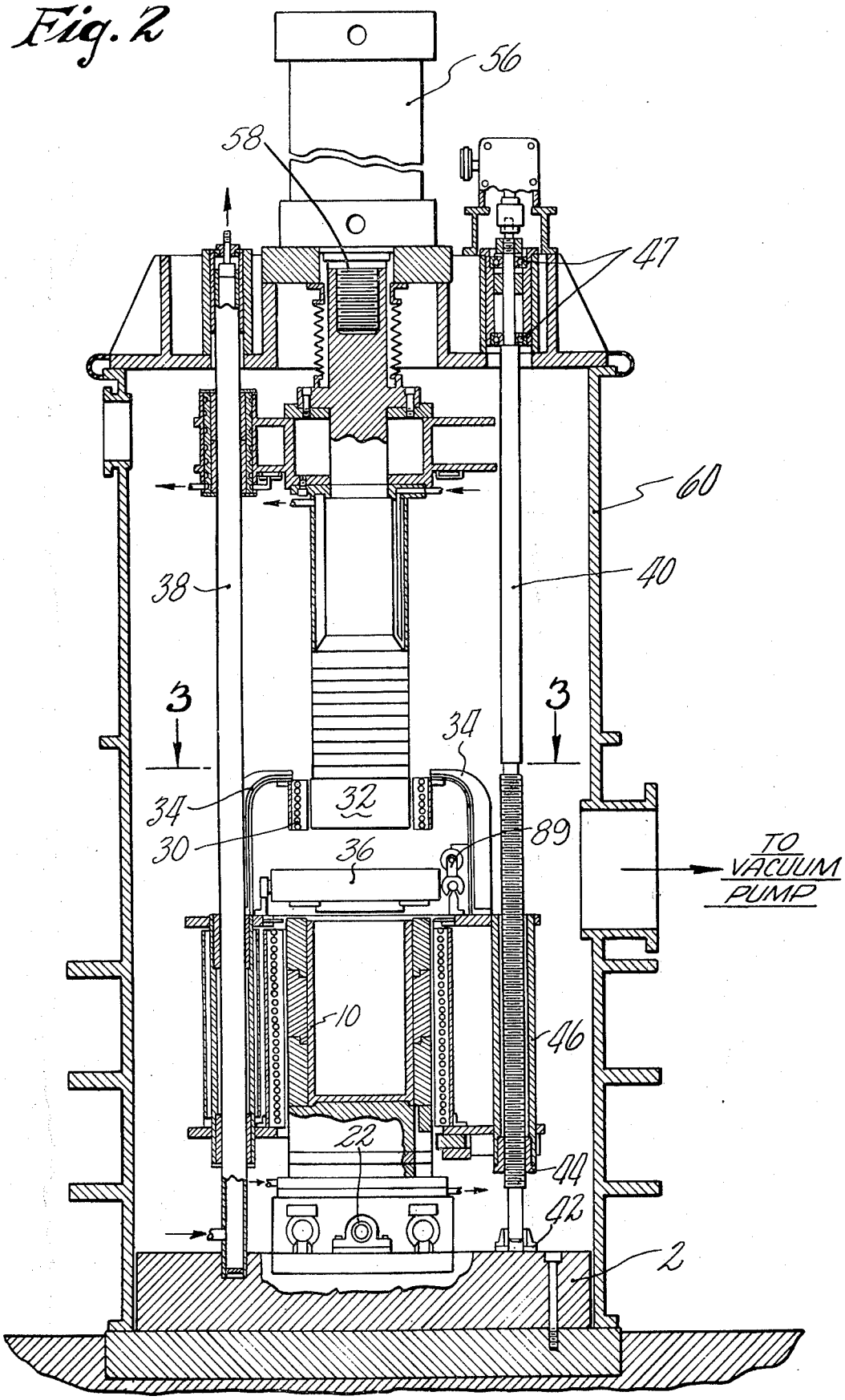
FIG. 2 is a vertical sectional view substantially at right angles to FIG. 1, more specifically substantially along line 2—2 of FIG. 3.

The heating coil 26 depends from a vertically movable carriage 28 which also supports the heating ring 30 surrounding the head 32 of the ram or plunger. This ring 30 is supported by brackets 34, FIGS. 2 and 4. The carriage 28 also supports a horizontally movable cover support 36, to be described in detail later.

Carriage 28 is guided for vertical movement by vertical tubes 38 which are fixed in the base plate 2 and slidable in the head plate to avoid thermal stresses. These tubes are also hollow and water cooled. Threaded rods 40 mounted in brackets 42 on the base plate, engage nuts 44 in vertical sleeves 46 on the carriage. These rods are mounted in bearings 47 in the head plate and are driven by a motor 48, FIG. 1, through a speed reduction arrangement 50, for the purpose of raising or lowering the carriage.

The particulate material is fed to the container as by a conveyor tube 52 extending through a furnace 54. This tube is withdrawn axially by suitable mechanism, not shown, so that it will not interfere with the vertical movement of the ram or the carriage 28 with the heating coil thereon. The vertical movement of the ram is by a hydraulic actuator 56 on the head plate, the piston rod or plunger 58 of the actuator being connected to the upper end of the ram.

The press is positioned within an enclosure 60, suitable for use as a vacuum chamber and a vacuum tight door 62 permits access to the container and to the cover positioning apparatus. Obviously, before lateral movement of the container with the surrounding support ring toward the door 62 the heating coil 26 will have been moved upward out of operative position.

Figure 4:
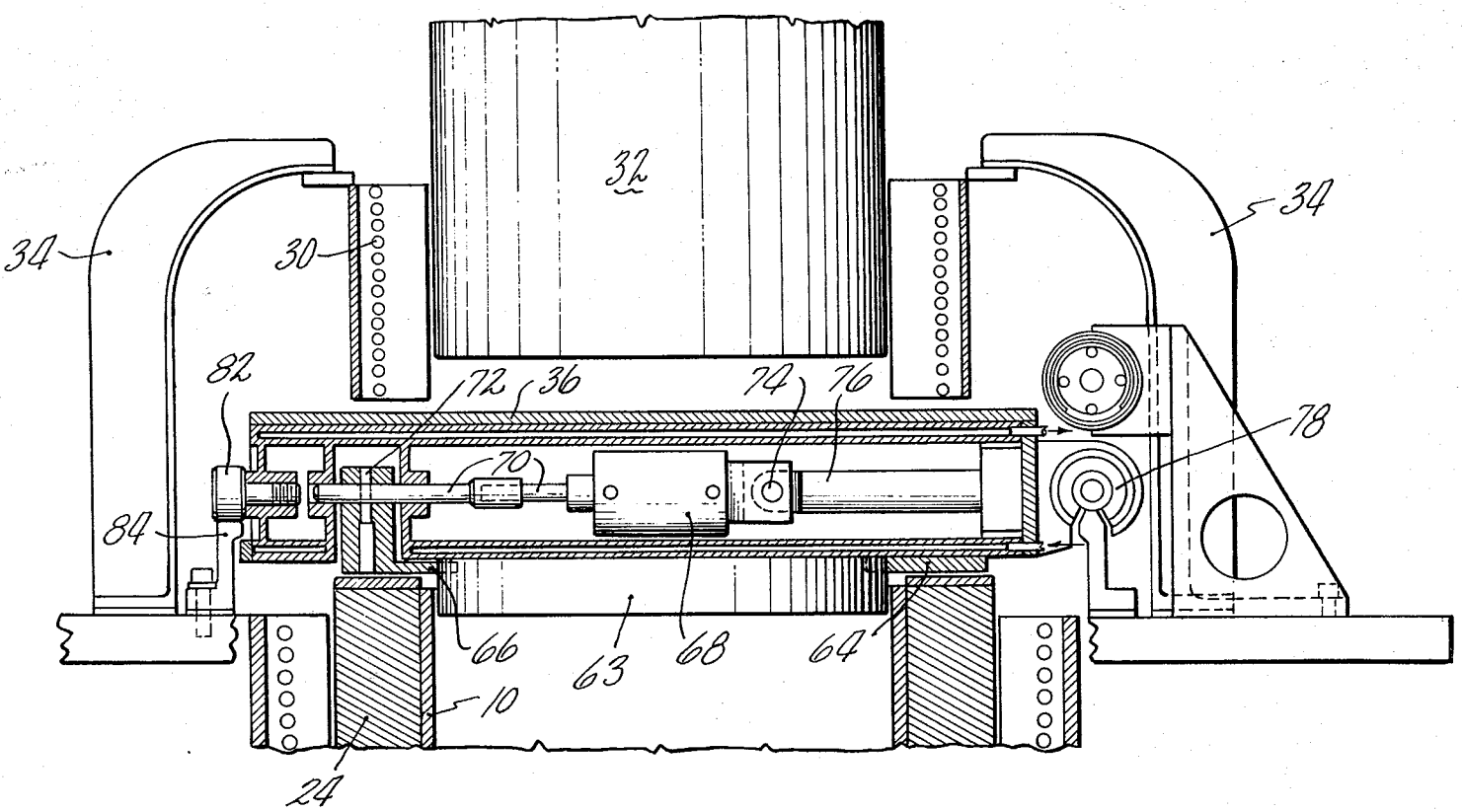
FIG. 4 is a vertical sectional view through a portion of the press with the cover in position over the container.

The cover 63 for the container is clamped onto the underside of the cover support 36 by opposed jaws 64 and 66. Jaw 64 is fixed on the support 36 and jaw 66 is movable toward and away from jaw 64 to clamp and release the cover. This jaw 66 is moved by a pneumatic actuator 68, the piston rod 70 of which is pinned 72 to the jaw 66. For convenience, the actuator is pinned 74 to a rod 76 secured to the support 36 as shown in FIG. 4. The location of the jaws on the support is such that, when the support 36 is above the container, the cover will be in a position to enter the upper end of the container when the carriage 28 is moved downwardly from its normal position. In this position, FIG. 4, the jaws release the cover, the support 36 is moved laterally, and the ram is moved down to force the cover into secure relation to the container and to the particulate matter therein. The support 36 may be water cooled to avoid thermal stresses in the actuating mechanism.

Support 36 is guided on the carriage 28 by a horizontal rod 78 mounted on the carriage and engaging a guide 80 on the support. The other end of the support 36 has a roller 82 engaging a horizontal guide 84 on the carriage. This guide structure for the cover support permits expansion of the support under high temperatures without causing thermal stresses.

Figure 3:
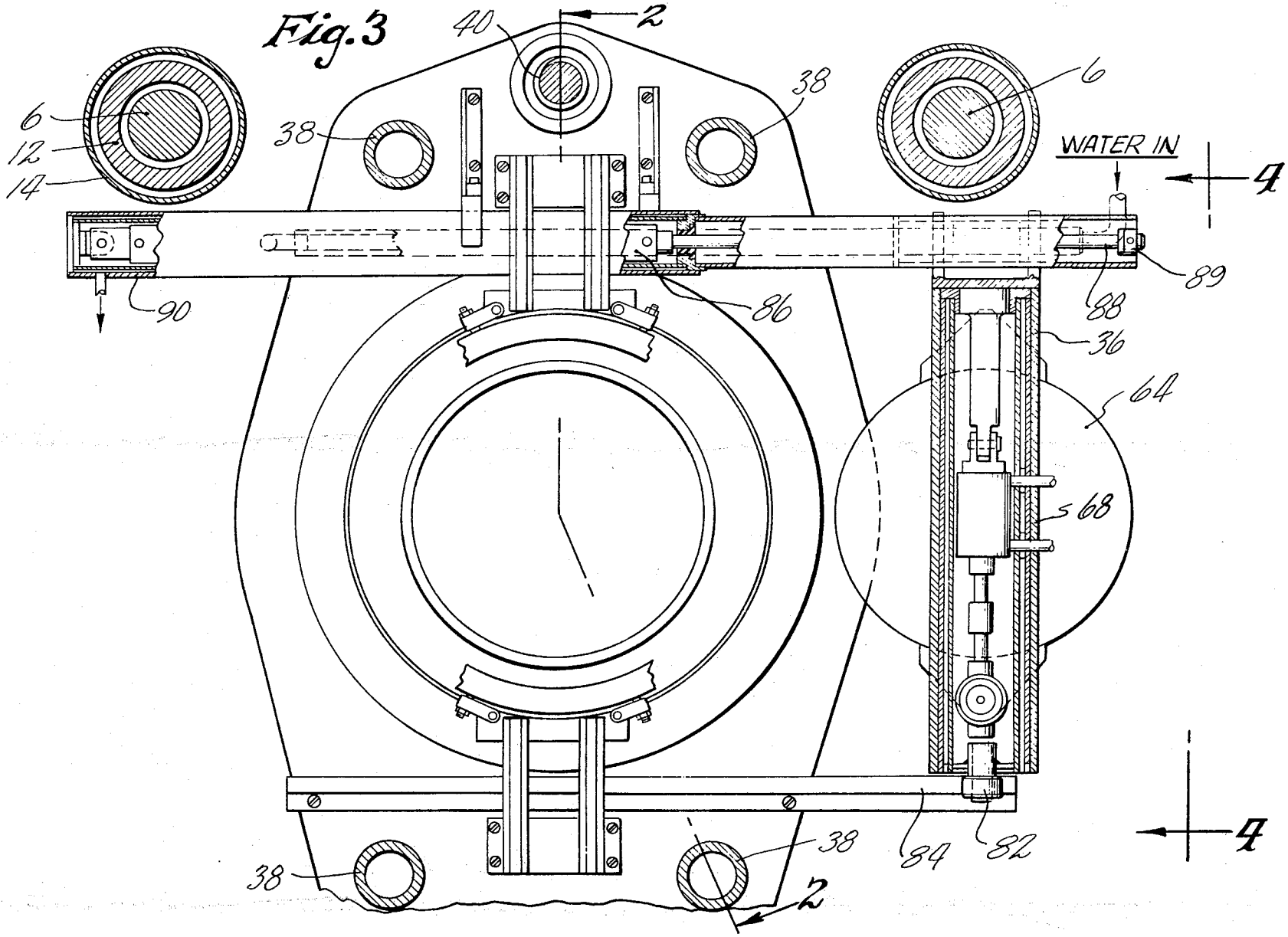
FIG. 3 is a horizontal sectional view along line 3—3 of FIG. 2.

The cover support is moved from the inoperative or loading position of FIG. 3 into operative position over the container by an actuator 86 positioned above the cover support and having the projecting actuating rod 88 connected by an arm 89 on the rod to the carriage. The actuator 86 may be in a water jacketed enclosure 90.

In operation, the furnace having been heated to the desired temperature and the heating coil 26 and heating ring 30 being energized, particulate matter is delivered to the container 10 from the tube 52 until the container is nearly full. The tube is then retracted and the ram moved down to compact the material to the desired amount. The ram is withdrawn, the tube advanced and additional particulate material deposited.

After another withdrawal of the tube the ram is again advanced for compression of the added material. With the ram again withdrawn the cover support is advanced to position the cover over the support and the carriage 28 is then moved down a small amount to position the cover within the end of the filled container as in FIG. 4. The cover is released from the jaws and the cover support returned to the position of FIG. 3. The ram is then moved down to push the cover further to compact the particulate material the final amount.

The cover is positioned within the container at a relatively cool temperature and the container is at a high temperature, for example, around 2000° F. The dimension of the cover is selected so that under these conditions the cover will fit within the container readily. However, as the container cools at the completion of the operation it will contract and desirably the thermal contraction will assure a tight fit with the cover. It may be desirable to provide sealing ribs on the periphery of the cover to assure a tight fit.

The carriage 28 is then moved upwardly carrying with it the heating coil, the heating ring, and the cover support until the bottom of the heating coil 26 is above the top of the container. It is now possible to move the slide 18 laterally carrying the container and support rings toward the access door for easy removal of the container. The vacuum is relieved in the enclosure before the door can be opened for removal of the container.

This type of device has many uses in preparation of billets for further forging, heat treating or other heat or pressure treatment. Since preparation of the billet, that is, the filled and sealed container, requires in many instances quite high temperatures close to the melting temperatures of the metal or alloy or other material being compacted, this present concept includes devices to protect operating parts from overheating and from thermal stresses. This is particularly important where the particulate material is in or is being put into a superplastic state during the heating and compacting operation.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of my invention, that which I claim as new and desire to secure by Letters Patent of the United States is:

1. In a press construction, a base plate supporting a container, a ram movable toward and away from the container for compacting particulate material therein, clamping means for releasably holding a cover to be positioned on the container, and a movable support for said clamping means to position the cover carried thereby in position over the container, said support being horizontally movable within the press from a loading position out of line with the ram to a position directly above the container.

2. A press construction as in claim 1 including a vertically movable carriage for the support for moving the cover downwardly into the end of the container when the support is above the container.

3. A press construction as in claim 2 including a heating device positioned on said carriage and normally in surrounding relation to the container.

4. A press construction as in claim 1 in which the clamping means includes spaced jaws on the support, one of which is movable relative to the other, and means on the support for moving said movable jaw into cover clamping position.

5. A press for compacting particulate material in a container, said press including:

a base plate on which the container is supported;

a ram movable toward and away from the base plate for compacting material in the container, the latter being in alignment with the ram to receive the end thereof;

cover clamping means normally offset from the ram for holding a cover for the container; and support means for moving said clamping means into alignment with the ram to position the clamped cover over the container.

6. A press as in claim 5 including other means for moving said support means downwardly to move the clamping means toward the base plate to position the cover within the end of the container.

7. A press as in claim 6 including a heating device positioned above the base plate in a position to surround and heat the container, said device being carried by and movable with said other means.

8. A press as in claim 6 in which the support means includes a horizontally movable support on which the clamping means is mounted, and the other means is a carriage guided for vertical movement toward and away from the base plate, thereby positioning the cover in the container.

* * * * *